US010078991B2

(12) United States Patent
Tian et al.

(10) Patent No.: US 10,078,991 B2
(45) Date of Patent: Sep. 18, 2018

(54) LIQUID CRYSTAL DRIVING CIRCUIT HAVING A MAIN PIXEL AND A SUBPIXEL AND LIQUID CRYSTAL DISPLAY DEVICE

(71) Applicant: Wuhan China Star Optoelectronics Technology Co., Ltd., Wuhan (CN)

(72) Inventors: Yong Tian, Wuhan (CN); Xin Zhang, Wuhan (CN)

(73) Assignee: Wuhan China Star Optoelectronics Technology Co., Ltd., Wuhan (CN)

( * ) Notice: Subject to any disclaimer, the term of this patent is extended or adjusted under 35 U.S.C. 154(b) by 12 days.

(21) Appl. No.: 15/310,100

(22) PCT Filed: Aug. 26, 2016

(86) PCT No.: PCT/CN2016/096872

§ 371 (c)(1),
(2) Date: Nov. 10, 2016

(87) PCT Pub. No.: WO2018/014416

PCT Pub. Date: Jan. 25, 2018

(65) Prior Publication Data

US 2018/0025693 A1 Jan. 25, 2018

(30) Foreign Application Priority Data

Jul. 19, 2016 (CN) ..... 2016 1 0570696

(51) Int. Cl.
*G09G 3/36* (2006.01)

(52) U.S. Cl.
CPC ... *G09G 3/3648* (2013.01); *G09G 2300/0819* (2013.01); *G09G 2310/0251* (2013.01); *G09G 2320/0242* (2013.01); *G09G 2320/0247* (2013.01)

(58) Field of Classification Search
CPC ..... G09G 3/3648
USPC ..... 345/214
See application file for complete search history.

(56) References Cited

U.S. PATENT DOCUMENTS

| | | | | |
|---|---|---|---|---|
| 8,928,568 | B2 | 1/2015 | Chiang et al. | |
| 9,218,777 | B2 | 12/2015 | Yao et al. | |
| 2010/0220116 | A1 | 9/2010 | Liao et al. | |
| 2015/0070613 | A1* | 3/2015 | Dong | G02F 1/13624 349/43 |
| 2016/0035292 | A1* | 2/2016 | Lee | G09G 3/3648 345/694 |
| 2016/0351143 | A1 | 12/2016 | Tian et al. | |

FOREIGN PATENT DOCUMENTS

| | | |
|---|---|---|
| CN | 103389604 | 11/2013 |
| CN | 104882105 | 9/2015 |
| JP | 2012-53257 | 3/2012 |
| TW | 201321875 | 6/2013 |

* cited by examiner

*Primary Examiner* — Long D Pham

(57) ABSTRACT

The present invention provides a liquid crystal driving circuit for providing power to the pixel units of a liquid crystal display device. The present invention further provides the liquid crystal display device, which comprises pixel units and the liquid crystal driving circuit.

18 Claims, 2 Drawing Sheets

LIQUID CRYSTAL DRIVING CIRCUIT HAVING A MAIN PIXEL AND A SUBPIXEL AND LIQUID CRYSTAL DISPLAY DEVICE

RELATED APPLICATIONS

This application is a National Phase of PCT patent application Ser. No. PCT/CN2016/096872 having International filing date of Aug. 26, 2016, which claims the benefit of priority of Chinese Patent Application No. 201610570696.0 filed on Jul. 19, 2016. The contents of the above applications are all incorporated by reference as if fully set forth herein in their entirety.

FIELD AND BACKGROUND OF THE INVENTION

The present invention relates to the field of liquid crystal display (LCD) technology, and more particularly to a liquid crystal driving circuit and a LCD device.

In a typical thin film transistor (TFT) display devices, especially those applicable for large size liquid crystal displays using vertical alignment (VA) liquid crystal mode, color shifting on large viewing angles easily happens. In the typical art, generally, a 3T driving circuit is applied to solve the issue about color shifting on large viewing angles. In other words, one gate line is used to control three TFTs within one pixel, to achieve low color shift. One pixel region is divided into a main pixel and a sub pixel, in a video (grey level) signal, making the main pixel and the sub pixel have different voltages, such that the main pixel and the sub pixel represent different gamma curves. A combined gamma curve of the gamma curves of the main pixel and the sub pixel decreases a difference between a large viewing angle and a positive viewing angle, to achieve low color shift.

FIG. 1 shows an illustrative structural drawing of a typical 3T driving circuit, which comprises three electrical switches T101-T103 and four capacitors C201-C204. A pixel unit comprises a main pixel 100 and a sub pixel 200. The first electrical switch T101, the first capacitor C201, and the second capacitor C202 are disposed in the main pixel 100. The second electrical switch T102, the third electrical switch T103, the third capacitor C203, and the fourth capacitor C204 are disposed in the sub pixel 100. Control terminals of the first electrical switch T101, the second electrical switch T102, and the third electrical switch T103 connect with a gate terminal 301. First terminals of the first capacitor C201 and the second capacitor C202 connect with a data terminal 302, to receive a charging voltage. The third capacitor C203 and the fourth capacitor C204 connect with a second terminal of the second electrical switch T102 and a first terminal of the third electrical switch T103. The first capacitor C201, the second capacitor C202, the third capacitor C203, the fourth capacitor C204, and a second terminal of the third electrical switch T103 connect with a common terminal 303, to receive a common voltage.

While applying 3T driving circuit to achieve low color shifting, there is an issue for the main pixel and the sub pixel have different common voltages. The voltages of the main pixel and the sub pixel cannot be consistent thus resulting in scrambled images and flickering images that seriously affect the liquid crystal display device.

SUMMARY OF THE INVENTION

An objective of the present invention is to provide a liquid crystal driving circuit for solving a technical issue about the difference between a common voltage of a main pixel and a common voltage of a sub pixel whining a pixel unit.

In order to achieve the objective, the present invention provides a technical proposal as below: a liquid crystal driving circuit which is used for providing power to pixel units of a liquid crystal display device and comprises:

A first electrical switch, which comprises a control terminal of the first electrical switch, a first terminal of the first electrical switch, and a second terminal of the first electrical switch. A second electrical switch, which comprises a control terminal of the second electrical switch, a first terminal of the second electrical switch, and a second terminal of the second electrical switch. A third electrical switch, which comprises a control terminal of the third electrical switch, a first terminal of the third electrical switch, and a second terminal of the third electrical switch. A fourth electrical switch, which comprises a control terminal of the fourth electrical switch, a first terminal of the fourth electrical switch, and a second terminal of the fourth electrical switch. A fifth electrical switch, which comprises a first terminal of the fifth electrical switch, and a second terminal of the fifth electrical switch. A first capacitor, which comprises a first terminal of the first capacitor and a second terminal of the first capacitor. A second capacitor, which comprises a first terminal of the second capacitor and a second terminal of the second capacitor. A third capacitor, which comprises a first terminal of the third capacitor and a second terminal of the third capacitor. And a fourth capacitor, which comprises a first terminal of the fourth capacitor and a second terminal of the fourth capacitor. The control terminal of the first electrical switch, the control terminal of the second electrical switch, and the control terminal of the third electrical switch connect with a gate terminal. The first terminal of the first capacitor and the first terminal of the second capacitor connect with the control terminal of the first electrical switch. The second terminal of the first electrical switch and first terminal of the second electrical switch connect with a data terminal, receiving a charging voltage. The first terminal of the third capacitor and the first terminal of the fourth capacitor connect with the second terminal of the second electrical switch and the first terminal of the third electrical switch. The second terminal of the first capacitor, the second terminal of the second capacitor, the second terminal of the third capacitor, the second terminal of the fourth capacitor, and the second terminal of the third electrical switch connect with a common terminal, for receiving a common voltage. The control terminal of the fourth electrical switch connects with the gate terminal, for receiving a control signal. The first terminal of the fourth electrical switch connects with the second terminal of the second electrical switch, the second terminal of the fourth electrical switch connects with the first terminal of the fifth electrical switch. The second terminal of the fifth electrical switch connects with the common terminal, for receiving the common voltage.

Upon a condition that the control signal turns on the first electrical switch, the second electrical switch, and third electrical switch, performing a discharge to the first capacitor, the second capacitor, the third capacitor, and the fourth capacitor. A negative half cycle voltage signal of a voltage signal outputted from the data terminal turns on the fifth electrical switch, then turning on the fourth electrical switch, performing a compensation discharge to the third capacitor and the fourth capacitor via the fourth electrical switch. Upon a condition that the negative half cycle voltage signal of the voltage signal outputted from the data terminal turns on the fifth electrical switch, the third electrical switch and the fourth electrical switch discharge voltages across the third capacitor and the fourth capacitor simultaneously.

Upon a condition that the control signal turns on the first electrical switch, the second electrical switch and third electrical switch, performing a discharge to the first capacitor, the second capacitor, the third capacitor, and the fourth capacitor. A positive half cycle voltage signal of a voltage signal outputted from the data terminal turns off the fifth electrical switch, then turning off the fourth electrical switch. End-performing a compensation discharge to the third capacitor and the fourth capacitor via the fourth electrical switch. Upon a condition that the positive half cycle voltage signal of the voltage signal outputted from the data terminal turns off the fifth electrical switch. The third electrical switch and the fourth electrical switch end-perform discharges to the third capacitor and the fourth capacitor.

The pixel unit comprises a main pixel and a sub pixel. The first electrical switch, the first capacitor, and the second capacitor are disposed in the main pixel. The second electrical switch, the third electrical switch, the fourth electrical switch, the fifth electrical switch, the third capacitor, and the fourth capacitor are disposed in the sub pixel.

The first electrical switch, the second electrical switch, the third electrical switch, and the fourth electrical switch are transistors. The control terminal of the first electrical switch, the control terminal of the second electrical switch, the control terminal of the third electrical switch, the control terminal of the fourth electrical switch are gate electrodes of transistors. The first terminal of the first electrical switch, the first terminal of the second electrical switch, the first terminal of the third electrical switch, the first terminal of the fourth electrical switch are source electrodes of transistors. The second terminal of the first electrical switch, the second terminal of the second electrical switch, the second terminal of the third electrical switch, the second terminal of the fourth electrical switch are drain electrodes of transistors. The transistors are npn transistors.

The fifth electrical switch is a transistor, the fifth electrical switch further comprises a control terminal of the fifth electrical switch. The control terminal of the fifth electrical switch is a gate electrode of the transistor, the first terminal of the fifth electrical switch is a source electrode of the transistor, and the second terminal of the fifth electrical switch is a drain electrode of the transistor. The transistor is an npn transistor. The fifth electrical switch is a diode, the first terminal of the fifth electrical switch is a negative terminal of the diode, the second terminal of the fifth electrical switch, is a positive terminal of the diode.

Another objective of the present invention is to provide a liquid crystal display device, for solving the technical issue about scrambled images and flicker images existing in the typical liquid crystal display device.

In order to achieve the above objective, the present invention further provides another technical proposal: a liquid crystal display device, which comprises the pixel units and the liquid crystal driving circuit as mentioned above, the liquid crystal driving circuit is used for providing power to the pixel units.

The beneficial effect of the present invention is to provide a liquid crystal display device which comprises a liquid crystal driving circuit which is based on the 3T driving circuit, while keeping the ability of charge and discharge of the main pixel of the liquid crystal driving circuit the same, to enhance the ability of discharge of the sub pixel during the period of the negative half cycle voltage signal of the voltage signal, making the main pixel and the sub pixel have the same common voltage, then solving the technical issue about scrambled images and flicker images and enhancing the display quality.

DESCRIPTION OF SPECIFIC EMBODIMENTS OF THE INVENTION

Figure 1:
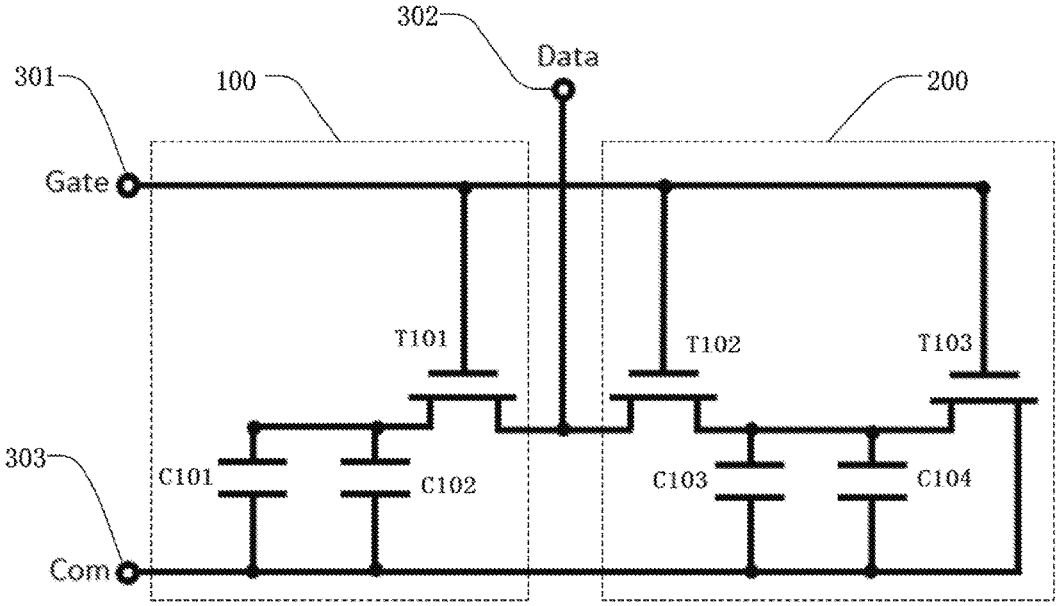
FIG. 1 (Prior Art)
FIG. 1 shows an illustrative structural drawing of a typical 3T driving circuit.

The following description with reference to the accompanying drawings of two preferred embodiments of the present invention, to prove that the present invention can be implemented, these embodiments can completely introduce the present invention those skilled in the art, to make its technology much more clear and easy to be understood. The present invention can be implemented via many different forms of embodiments, the scope of the present invention is not limited to the embodiments mentioned in the text.

In the drawings, the same parts of the structure are indicated with the same reference numerals, structure or functionally similar components are indicated with similar numerals. When a component is described as being "connected to" another component, these two components can be understood as direct "connection", or a component is "connected to" another component via an intermediate component. With combination of the drawings of embodiments of the present invention, to clearly and completely describe the technical proposal of the embodiments of the present invention.

Embodiment 1

Figure 2:
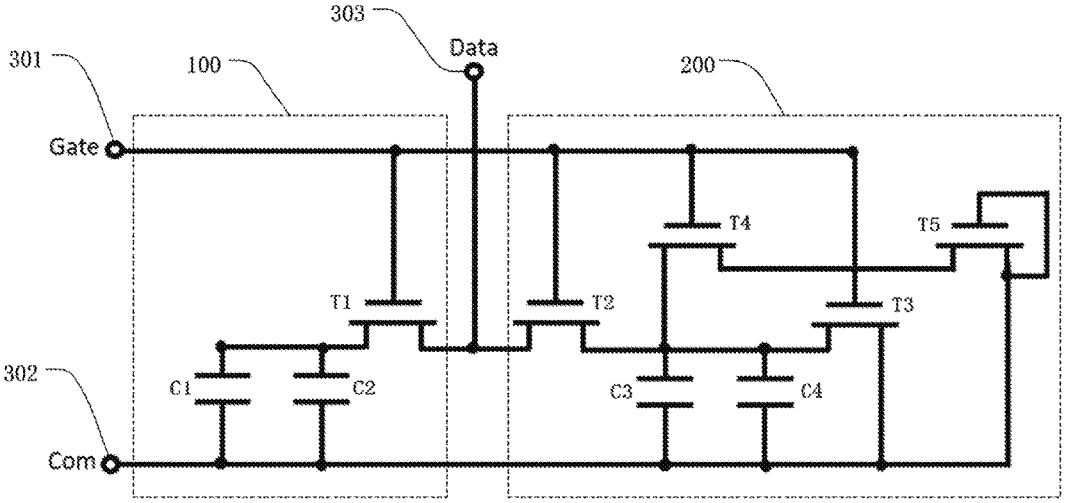
FIG. 2 shows an illustrative structural drawing of a liquid crystal driving circuit according to embodiment 1 of the present invention.
Figure 3:
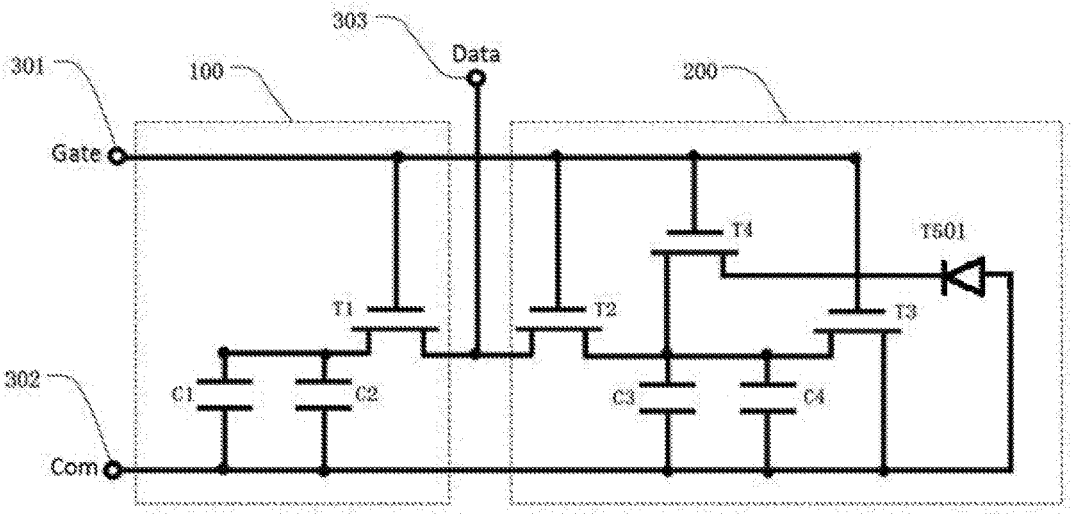
FIG. 3 shows an illustrative structural drawing of a liquid crystal driving circuit according to embodiment 2 of the present invention.

As FIG. 2 shown, the present invention provides a liquid crystal driving circuit used for providing power to pixel units of a liquid crystal display device, which comprises five electrical switches T1-T5 and four capacitors C1-C4. The pixel unit comprises a main pixel 100 and a sub pixel 200. The first electrical switch T1, the first capacitor C1, and the second capacitor C2 are disposed in the main pixel 100. The second electrical switch T2, the third electrical switch T3, the fourth electrical switch T4, the fifth electrical switch T5, the third capacitor C3, and the fourth capacitor C4 are disposed in the sub pixel 200.

In the embodiment, each one of the capacitors C1-C4 comprises a first terminal and a second terminal, each one of the electrical switches T1-T5 comprises a control terminal, a first terminal, and a second terminal. To be specific:

A first electrical switch T1 comprises a control terminal of the first electrical switch T1, a first terminal of the first electrical switch T1, and a second terminal of the first electrical switch T1. A second electrical switch T2 comprises a control terminal of the second electrical switch T2, a first terminal of the second electrical switch T2, and a second terminal of the second electrical switch T2. A third electrical switch T3 comprises a control terminal of the third electrical switch T3, a first terminal of the third electrical switch T3, and a second terminal of the third electrical switch T3. A fourth electrical switch T4 comprises a control terminal of the fourth electrical switch T4, a first terminal of the fourth electrical switch T4, and a second terminal of the fourth electrical switch T4. A fifth electrical switch T5 comprises a first terminal of the fifth electrical switch T5, and a second terminal of the fifth electrical switch T5. A first capacitor C1 comprises a first terminal of the first capacitor C1 and a second terminal of the first capacitor C1. A second capacitor C2 comprises a first terminal of the second capacitor C2 and a second terminal of the second capacitor C2. A third capacitor C3 comprises a first terminal of the third capacitor C3 and a second terminal of the third capacitor C3. A fourth capacitor C4 comprises a first terminal of the fourth capacitor C4 and a second terminal of the fourth capacitor C4.

In the embodiment, each electrical switch is transistor, the control terminal is the gate electrode of the transistor, the first terminal is the source electrode of the transistor, and the second terminal of the drain electrode of the transistor. In the embodiment, the transistors are npn transistors, in other embodiments, the transistors can be other types.

In the embodiment, the control terminal of the first electrical switch T1, the control terminal of the second electrical switch T2, the control terminal of the third electrical switch T3, and the control terminal of the fourth electrical switch T4 connect with a gate terminal 301 (Gate), for receiving the control signal. The first terminal of the first capacitor C1 and the first terminal of the second capacitor C2 connect with a data terminal 302 (Data), for receiving a charging voltage. The third capacitor C3 and the fourth capacitor C4 connect with the second terminal of the second electrical switch T2 and the first terminal of the third electrical switch T2. The first capacitor C1, the second capacitor C2, the third capacitor C3, the fourth capacitor C4, the third electrical switch T3, and the second terminal of the fifth electrical switch T5 connect with a common terminal 303 (Com) for receiving a common voltage. The first terminal of the fourth electrical switch T4 connects with the second terminal of the second electrical switch T2, the second terminal of the fourth electrical switch T4 connects with the first terminal of the fifth electrical switch T5. The second terminal of the fifth electrical switch T5 connects with the common terminal 303 (Com), for receiving the common voltage.

It should be appreciated that in order to prevent polarization of the liquid crystal of each pixel unit of the liquid crystal display device, a positive half cycle and a negative half cycle of the charging voltage is alternately applied while driving the liquid crystal display device. It is the positive half cycle, upon the condition that the charging voltage of the pixel unit is larger than the common voltage (Vcom). It is the negative half cycle, upon the condition that the charging voltage of the pixel unit is less than the common voltage (Vcom). In an ideal condition, we hope the pixel voltage of the main pixel and the pixel voltage of the sub pixel are identical, the common voltages (Vcom) are the same, the common voltage is disposed in the center of the positive half cycle and the negative half cycle, the main pixel has the same charging ability and discharging ability of the positive half cycle, the main pixel has the same charging ability and discharging ability of the negative half cycle. However, in real conditions, in the sub pixel, the pixel unit has a weaker charging ability with relative to the discharging ability at the positive half cycle, and a stronger charging ability with relative to the discharging ability at the negative half cycle. This non-symmetry of charging ability makes the common voltage of the pixel unit of the sub pixel less than the common voltage of the pixel unit of the main pixel, the common voltages cannot be identical, the common voltages Vcom of the whole pixel units cannot be setup up to a best mode, and causing image sticking and flickering images.

In the embodiment, adding the fourth electrical switch T4 and the fifth electrical switch T5 based on the driving circuit of the typical 3T driving circuit. To the main pixel of the pixel unit, the effective charging voltage and the effective discharging voltage at the negative half cycle will not change as the typical art.

To the sub pixel of the pixel unit, upon a condition that the first electrical switch T1, the second electrical switch T2, and third electrical switch T3 are turned on, performing a discharge to the first capacitor C1, the second capacitor C2, the third capacitor C3, and the fourth capacitor C4 at the negative half cycle of the charging voltage. The voltage signal outputted from the data terminal 302 (Data) turns on the fifth electrical switch T5, then turning on the fourth electrical switch T4. The third electrical switch T3, the fourth electrical switch T4, and the fifth electrical switch T5 are turned on simultaneously, performing a compensation discharge to the third capacitor C3 and the fourth capacitor C4 via the fourth electrical switch T4. Two TFTs perform the discharge to the third capacitor C3 and the fourth capacitor C4, the discharge of the sub pixel is speed up, in the sub pixel, the charging ability is decreased with relative to the discharging ability. Upon a condition that the charging voltage is at positive half cycle, the fourth electrical switch T4 is turned on. However, the fifth electrical switch T5 which is connected in parallel with the fourth electrical switch T4 is turned off, the fourth electrical switch T4 cannot work. The data terminal 302 (Data) outputs a positive half cycle of the voltage signal cuts off the fifth electrical switch T5, then cutting off the fourth electrical switch T4, to stop performing the compensation discharge to the third capacitor C3 and the fourth capacitor C4. Meanwhile, only the third electrical switch T3 still performs discharge to the third capacitor C3 and the fourth capacitor C4 of the sub pixel, the discharging ability is unchanged.

At the negative half cycle, the voltage of the sub pixel is decreased, at the positive half cycle, the voltage of the sub pixel is unchanged, the best common voltage Vcom of the sub pixel is increased to reduce the difference with the best common voltage Vcom of the main pixel. With adjusting the quantity of the fourth electrical switch T4 can adjust the best common voltage Vcom of the sub pixel to be identical with the best common voltage Vcom of the main pixel, then, in the whole pixel unit, the common voltages of the main pixel and the sub pixel reach to identical as the best mode.

The embodiment further provides a liquid crystal display device, which comprises the pixel units and the liquid crystal driving circuit as mentioned above (as FIG. 2), the liquid crystal driving circuit is used for providing power to the pixel units. The structure and the working principle of the liquid crystal driving circuit do not repeat again, the liquid crystal display device comprises the liquid crystal driving circuit won't have scrambled images and flicker images and enhancing the display quality. The liquid crystal display device of embodiment 1 can be mobile communication terminal (such as smart phone, tablet), display, television etc.

Embodiment 2

In the embodiment, most technical proposal are the same as the embodiment 1, the different technical feature is the fifth electrical switch T5 of the embodiment 2 is not a transistor, but a diode. The first terminal of the fifth electrical switch T501 is a negative terminal of the diode and connected with the source electrode of the fourth electrical switch T4, the second terminal of the fifth electrical switch T501 is a positive terminal of the diode and is connected with the common terminal 303 (Com), for receiving the common voltage.

The embodiment adds the fourth electrical switch T4 (TFT) and the fourth electrical switch T5 (diode) based on the typical 3T driving circuit. To the sub pixel of the pixel unit, upon a condition that the first electrical switch T1, the second electrical switch T2, and third electrical switch T3 are turned on, performing a discharge to the first capacitor C1, the second capacitor C2, the third capacitor C3, and the fourth capacitor C4 at the negative half cycle of the charging voltage. The voltage signal outputted from the data terminal 302 (Data) turns on the fifth electrical switch T5, then turning on the fourth electrical switch T4, performing a compensation discharge to the third capacitor C3 and the fourth capacitor C4 via the fourth electrical switch T4. Two TFTs perform the discharge to the third capacitor C3 and the fourth capacitor C4, the discharge of the sub pixel is speed up, in the sub pixel, the charging ability is decreased with relative to the discharging ability. Upon a condition that the charging voltage is at positive half cycle, the fifth electrical switch T5 which is connected in series with the fourth electrical switch T4 is a reversed diode, the fourth electrical switch T4 can't work. The data terminal 302 (Data) outputs a positive half cycle of the voltage signal cuts off the fifth electrical switch T5, then cutting off the fourth electrical switch T4, to stop performing the compensation discharge to the third capacitor C3 and the fourth capacitor C4. Meanwhile, only the third electrical switch T3 still performs discharge to the third capacitor C3 and the fourth capacitor C4 of the sub pixel, the discharging ability is unchanged.

At the negative half cycle, the voltage of the sub pixel is decreased, at the positive half cycle, the voltage of the sub pixel is unchanged, the best common voltage Vcom of the sub pixel is increased to reduce the difference with the best common voltage Vcom of the main pixel. With adjusting the quantity of the fourth electrical switch T4 can adjust the best common voltage Vcom of the sub pixel to be identical with the best common voltage Vcom of the main pixel, then, in the whole pixel unit, the common voltages of the main pixel and the sub pixel reach to identical as the best mode.

The embodiment 2 further provides a liquid crystal display device, which comprises the pixel units and the liquid crystal driving circuit as mentioned above (as FIG. 2), the liquid crystal driving circuit is used for providing power to the pixel units. The structure and the working principle of the liquid crystal driving circuit will not be repeated again, the liquid crystal display device comprises the liquid crystal driving circuit won't have scrambled images and flicker images and enhancing the display quality. The liquid crystal display device of embodiment 2 can be mobile communication terminal (such as smart phone, tablet), display, television, etc.

The present invention provides a liquid crystal driving circuit and a liquid crystal display device comprises the liquid crystal driving circuit based on the improvement of the typical 3T driving circuit, with keeping the charging ability of the main pixel of the liquid crystal driving circuit unchanged and appropriate enforcement to the discharging ability of the sub pixel at the negative half cycle of the voltage signal, making the main pixel and the sub pixel have identical common voltage, to solve the technical issue about scrambled images and flickering images existing in the typical liquid crystal display device, and to enhance the display quality Although the present invention has been disclosed as preferred embodiments, the foregoing preferred embodiments are not intended to limit the present invention. Those of ordinary skill in the art, without departing from the spirit and scope of the present invention, can make various kinds of modifications and variations to the present invention. Therefore, the scope of the claims of the present invention must be defined.

What is claimed is:

1. A liquid crystal driving circuit for providing power to pixel units of a liquid crystal display device, comprising:

a first electrical switch comprising a control terminal of the first electrical switch, a first terminal of the first electrical switch, and a second terminal of the first electrical switch;

a second electrical switch comprising a control terminal of the second electrical switch, a first terminal of the second electrical switch, and a second terminal of the second electrical switch;

a third electrical switch comprising a control terminal of the third electrical switch, a first terminal of the third electrical switch, and a second terminal of the third electrical switch;

a fourth electrical switch comprising a control terminal of the fourth electrical switch, a first terminal of the fourth electrical switch, and a second terminal of the fourth electrical switch; and a fifth electrical switch comprising a first terminal of the fifth electrical switch, and a second terminal of the fifth electrical switch;

a first capacitor comprising a first terminal of the first capacitor and a second terminal of the first capacitor;

a second capacitor comprising a first terminal of the second capacitor and a second terminal of the second capacitor;

a third capacitor comprising a first terminal of the third capacitor and a second terminal of the third capacitor; and a fourth capacitor comprising a first terminal of the fourth capacitor and a second terminal of the fourth capacitor;

wherein the control terminal of the first electrical switch, the control terminal of the second electrical switch, and the control terminal of the third electrical switch connect with a gate terminal; the first terminal of the first capacitor and the first terminal of the second capacitor connect with the control terminal of the first electrical switch; the second terminal of the first electrical switch and first terminal of the second electrical switch connect with a data terminal, receiving a charging voltage; the first terminal of the third capacitor and the first terminal of the fourth capacitor connect with the second terminal of the second electrical switch and the first terminal of the third electrical switch; the second terminal of the first capacitor, the second terminal of the second capacitor, the second terminal of the third capacitor, the second terminal of the fourth capacitor, and the second terminal of the third electrical switch connect with a common terminal, for receiving a common voltage;

wherein the control terminal of the fourth electrical switch connects with the gate terminal, for receiving a control signal; the first terminal of the fourth electrical switch connects with the second terminal of the second electrical switch, the second terminal of the fourth electrical switch connects with the first terminal of the fifth electrical switch; the second terminal of the fifth electrical switch connects with the common terminal, for receiving the common voltage;

wherein upon a condition that the control signal turns on the first electrical switch, the second electrical switch, and third electrical switch, performing a discharge to the first capacitor, the second capacitor, the third capacitor, and the fourth capacitor;

if a negative half cycle voltage signal of a voltage signal outputted from the data terminal turns on the fifth electrical switch, then turning on the fourth electrical switch, performing a compensation discharge to the third capacitor and the fourth capacitor via the fourth electrical switch;

if a positive half cycle voltage signal of a voltage signal outputted from the data terminal turns off the fifth electrical switch, then turning off the fourth electrical switch, end-performing a compensation discharge to the third capacitor and the fourth capacitor via the fourth electrical switch.

2. The liquid crystal driving circuit according to claim 1, wherein upon a condition that the negative half cycle voltage signal of the voltage signal outputted from the data terminal turns on the fifth electrical switch, the third electrical switch and the fourth electrical switch discharge voltages across the third capacitor and the fourth capacitor simultaneously.

3. The liquid crystal driving circuit according to claim 1, wherein upon a condition that the positive half cycle voltage signal of the voltage signal outputted from the data terminal turns off the fifth electrical switch, the third electrical switch, the fourth electrical switch end-perform discharges to the third capacitor and the fourth capacitor.

4. The liquid crystal driving circuit according to claim 1, wherein the pixel unit comprises a main pixel and a sub pixel.

5. The liquid crystal driving circuit according to claim 4, wherein the first electrical switch, the first capacitor, and the second capacitor are disposed in the main pixel.

6. The liquid crystal driving circuit according to claim 4, wherein the second electrical switch, the third electrical switch, the fourth electrical switch, the fifth electrical switch, the third capacitor, and the fourth capacitor are disposed in the sub pixel.

7. The liquid crystal driving circuit according to claim 1, wherein the first electrical switch, the second electrical switch, the third electrical switch, and the fourth electrical switch are transistors.

8. The liquid crystal driving circuit according to claim 7, wherein the control terminal of the first electrical switch, the control terminal of the second electrical switch, the control terminal of the third electrical switch, the control terminal of the fourth electrical switch are gate electrodes of transistors.

9. The liquid crystal driving circuit according to claim 7, wherein the first terminal of the first electrical switch, the first terminal of the second electrical switch, the first terminal of the third electrical switch, the first terminal of the fourth electrical switch are source electrodes of transistors.

10. The liquid crystal driving circuit according to claim 7, wherein the second terminal of the first electrical switch, the second terminal of the second electrical switch, the second terminal of the third electrical switch, the second terminal of the fourth electrical switch are drain electrodes of transistors.

11. The liquid crystal driving circuit according to claim 7, wherein the transistors are npn transistors.

12. The liquid crystal driving circuit according to claim 1, wherein the fifth electrical switch is a transistor, the fifth electrical switch further comprises a control terminal of the fifth electrical switch.

13. The liquid crystal driving circuit according to claim 12, wherein the control terminal of the fifth electrical switch is a gate electrode of the transistor, the first terminal of the fifth electrical switch is a source electrode of the transistor, and the second terminal of the fifth electrical switch is a drain electrode of the transistor.

14. A liquid crystal display device, comprising the pixel units and the liquid crystal driving circuit according to claim 13, wherein the liquid crystal driving circuit is used for providing power to the pixel units.

15. The liquid crystal driving circuit according to claim 12, wherein the transistor is an npn transistor.

16. The liquid crystal driving circuit according to claim 1, wherein the fifth electrical switch is a diode, the first terminal of the fifth electrical switch is a negative terminal of the diode, the second terminal of the fifth electrical switch is a positive terminal of the diode.

17. A liquid crystal display device, comprising the pixel units and the liquid crystal driving circuit according to claim 16, wherein the liquid crystal driving circuit is used for providing power to the pixel units.

18. A liquid crystal display device, comprising the pixel units and the liquid crystal driving circuit according to claim 1, wherein the liquid crystal driving circuit is used for providing power to the pixel units.

* * * * *